United States Patent [19]

Tweg

[11] Patent Number: 4,496,325

[45] Date of Patent: Jan. 29, 1985

[54] COLLAPSIBLE PADDLE BOAT

[76] Inventor: Edward Tweg, 51 Shderot Herzl, Ramle, Israel

[21] Appl. No.: 407,463

[22] Filed: Aug. 12, 1982

[30] Foreign Application Priority Data

May 13, 1982 [IL] Israel ..... 65768

[51] Int. Cl.[3] ..... B63H 16/12

[52] U.S. Cl. ..... 440/26; 114/61; 114/354; 440/94

[58] Field of Search ..... 114/61, 353, 354; 440/24, 24–32, 94

[56] References Cited

U.S. PATENT DOCUMENTS

| | | | |
|---|---|---|---|
| 381,729 | 4/1888 | Tibbles | 440/94 X |
| 1,692,753 | 11/1928 | Meyer | 440/31 |
| 2,468,889 | 5/1949 | Montalbano . | |
| 2,592,498 | 4/1952 | Wells . | |
| 3,039,422 | 6/1962 | Baker . | |
| 3,139,061 | 6/1964 | Johnston . | |
| 3,143,992 | 8/1964 | Beams | 114/61 |
| 3,249,084 | 5/1966 | Plants . | |
| 3,352,276 | 11/1967 | Zimmerman . | |
| 3,410,244 | 11/1968 | Graham . | |
| 3,476,072 | 11/1969 | Wilson . | |
| 3,640,239 | 2/1972 | Petrosky . | |
| 3,756,187 | 10/1973 | Livaudais . | |
| 3,756,189 | 9/1973 | Yutzler . | |
| 3,874,319 | 4/1975 | Martin et al. . | |
| 3,922,994 | 12/1975 | De Long . | |
| 3,954,079 | 5/1976 | Gof . | |

FOREIGN PATENT DOCUMENTS

| | | | |
|---|---|---|---|
| 1076257 | 10/1954 | France | 440/28 |
| 1315814 | 12/1963 | France | 440/26 |
| 974208 | 11/1964 | United Kingdom . | |
| 1074609 | 7/1967 | United Kingdom . | |

*Primary Examiner*—Sherman D. Basinger

*Attorney, Agent, or Firm*—Browdy and Neimark

[57] ABSTRACT

A paddle boat comprising a plurality of floats, collapsible driving and propelling apparatus, folding steering apparatus, the driving and propelling apparatus and steering apparatus adapted for mounting onto the floats during use of the paddle boat, particularly wherein the driving and propelling apparatus includes a paddle adapted to remain in a substantially vertical orientation during movement of the boat. Preferably, the driving and propelling apparatus comprises a stationary base element foldably mounted onto the main frame and defining a first rotation axis, a crank shaft defining at least one arm and an axle portion rotatably mounted onto the stationary base for rotation about the first rotation axis, a stationary extension element foldably mounted onto the base element and defining a second rotation axis parallel to and spaced from the first rotation axis, a paddle mounted upon each of the arms, at least one rod rotatably mounted onto the extension element and arranged for rotation about the second rotation axis through a restricted arc, and a member slideable relative to each rod and fixedly mounted onto each of the arms, whereby rotation of the arms about the first rotation axis causes the member to move slideably with relation to the rod and cause its rotation about the second rotation axis, the paddle being adapted for movement along the length of the rod as it rotates through the restricted arc such that the paddle remains in a substantially vertical orientation throughout its movement.

9 Claims, 8 Drawing Figures

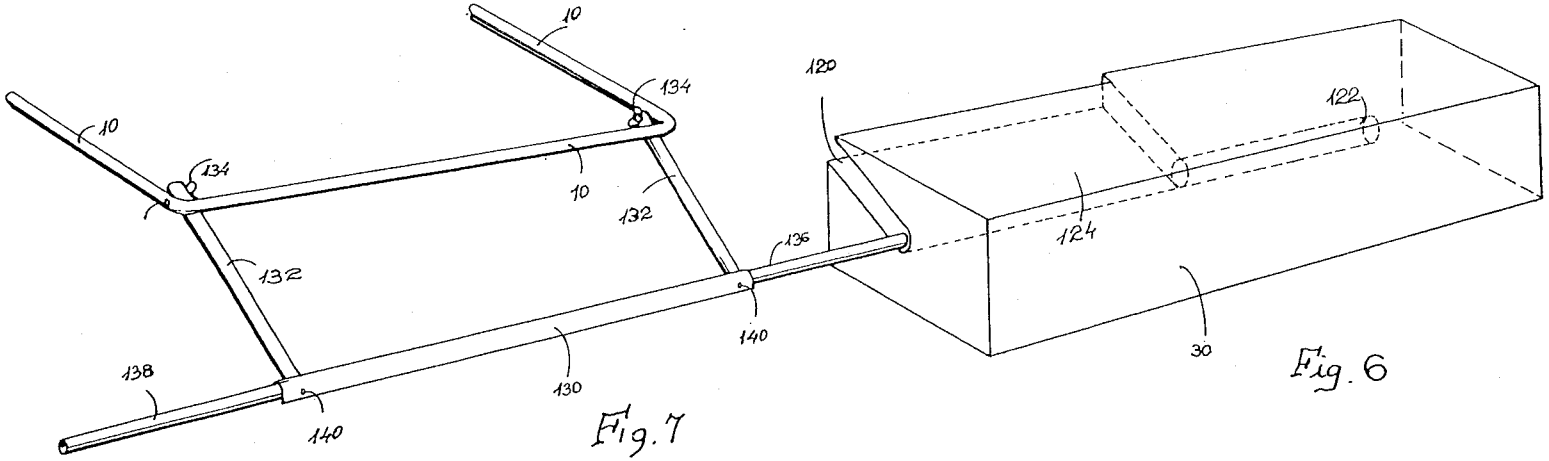
Fig. 6
Fig. 7
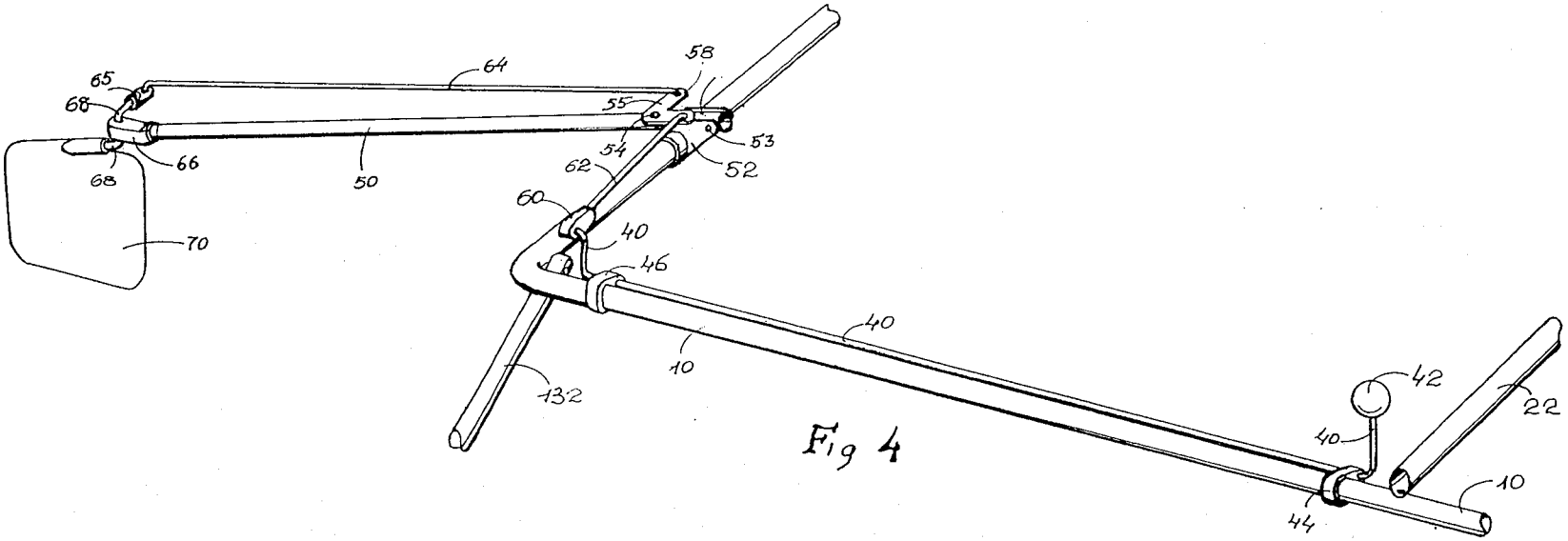
Fig 4

COLLAPSIBLE PADDLE BOAT

FIELD OF THE INVENTION

This invention relates to collapsible paddle boats in general and, in particular, to portable, foldable vessels powered by pedal-driven paddles.

BACKGROUND OF THE INVENTION

There exist on the market today a number of boats which are powered by pedal-driven paddle wheels. Such water cycles are disclosed, for example, in U.S. Pat. Nos. 3,640,239, which discloses a float apparatus for attachment to a conventional bicycle; 3,039,422, which discloses a paddle apparatus comprising a drive gear, a foot pedal affixed to a spring mounted drive rod and a paddle attached to a power arm; U.S. Pat. No. 3,120,833, which discloses a paddle boat in the shape of a swan, comprising a body member and a foot pedal driving mechanism which drives a paddle assembly; U.S. Pat. No. 3,249,084, which discloses a water tricycle comprising spaced and aligned cylindrical floats manually rotated by foot cranks. Other water cycles are disclosed in U.S. Pat. No. 3,954,079, which discloses a dual hull water bicycle for use over land and water; U.S. Pat. No. 3,352,276, which discloses a pontoon boat cycle drive; U.S. Pat. No. 3,756,187, which discloses a device for walking on water; and U.S. Pat. No. 3,756,189, a water vehicle comprising a motorcycle-type body supported on three pontoons.

Yet another model of paddle boat is that which is often available for rental at beaches and lakefront resorts. This craft comprises a fibreglas body affixed to floats and powered by a paddle wheel driven by pedals mounted on a crank shaft.

A number of portable craft are disclosed in the patent literature. British Pat. No. 974,208 discloses pedal operated inflatable catamarans comprising a pair of inflatable floats and pedal operable propulsion means comprising paddles attached to the ends of a two-part cranked shaft. U.S. Pat. No. 2,468,889 discloses a portable propelling apparatus for boats comprising a longitudinally adjustable frame extending along the length of the boat and a U-shaped member connected to the frame onto which are mounted arms supporting water wheels whose depth is adjustable. U.S. Pat. No. 2,592,498 discloses pedal boat propulsion apparatus comprising a paddle arm operated by a pedal, mountable on the inner surface of the side of a boat. British Pat. No. 1,074,609 discloses a collapsible water cycle comprising a pair of hollowed out floats which serve as a casing, and a tubular armature embedded in the floats to support the driving and propelling assembly which is affixed thereto as the hinged, folding central axis of the floats. The propelling assembly comprises a propeller driven by gears via transmission means.

Additional boat propelling assemblies are described in U.S. Pat. Nos. 3,139,061 and 3,225,733 which provide propulsion mechanisms for boats with transoms; U.S. Pat. No. 3,410,244 which discloses an amphibious boat; U.S. Pat. No. 3,476,072, which discloses a hydrofoil propelled water craft; U.S. Pat. No. 3,874,319, which discloses a manually propelled water craft; and U.S. Pat. No. 3,922,994 which discloses a twin hulled outrigger sailboat.

SUMMARY OF THE INVENTION

It is an object of the present invention to provide a light weight, foldable, collapsible, portable paddle boat of simple construction.

There is thus provided in accordance with the present invention a paddle boat comprising a plurality of floats, collapsible driving and propelling apparatus, folding steering apparatus, the driving and propelling apparatus and steering apparatus adapted for mounting onto the floats during use of the paddle boat. In particular, the driving and propelling apparatus includes a paddle adapted to remain in a substantially vertical orientation during movement of the boat.

There is further provided such a paddle boat wherein the driving and propelling apparatus comprises a stationary base element foldably mounted onto the main frame and defining a first rotation axis, a crank shaft defining at least one arm and an axle portion rotatably mounted onto said stationary base for rotation about the first rotation axis, a stationary extension element foldably mounted onto said base element and defining a second rotation axis parallel to and spaced from the first rotation axis, a paddle mounted upon each of the arms, at least one rod rotatably mounted onto the extension element and arranged for rotation about the scored rotation axis through a restricted arc, and a member arranged for slideable relative movement relative to each rod and fixedly mounted onto each of the arms, whereby rotation of the arms about the first rotation axis causes the member to move slideably with relation the rod and cause its rotation about the second rotation axis, the paddle being adapted for movement along the length of the rod as it rotates through the restricted arc such that the paddle remains in a substantially vertical orientation throughout its movement.

There is still further provided such a paddle boat and further comprising connection apparatus foldably attached to the main frame and adapted for removable insertion into the floats for mounting the main frame on the floats.

BRIEF DESCRIPTION OF THE DRAWINGS

The present invention will be further understood and appreciated from the following detailed description taken in conjunction with the drawings in which:

FIG. 4 is a detailed illustration of the steering mechanism of the paddle boat of FIG. 1;

FIG. 6 is a detailed illustration of a float suitable for use in the paddle boat of FIG. 1; and FIG. 7 is a detailed illustration of the apparatus for mounting the steering and driving and propelling mechanisms onto the floats for use of the paddle boat of the present invention.

DETAILED DESCRIPTION OF THE INVENTION

Figure 1:
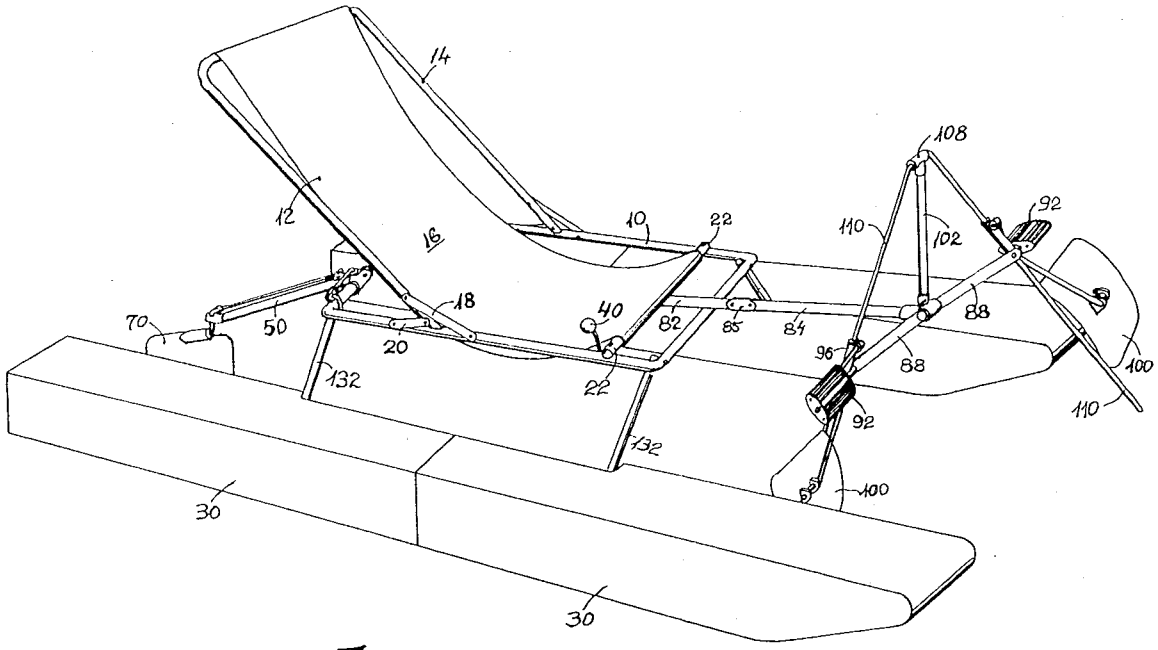
FIG. 1 is an illustration of a paddle boat designed and constructed in accordance with an embodiment of the present invention in a fully extended orientation for use.

With reference to FIG. 1 there is shown a paddle boat designed and constructed in accordance with an embodiment of the present invention in a fully expanded orientation and ready for use.

Figure 2:
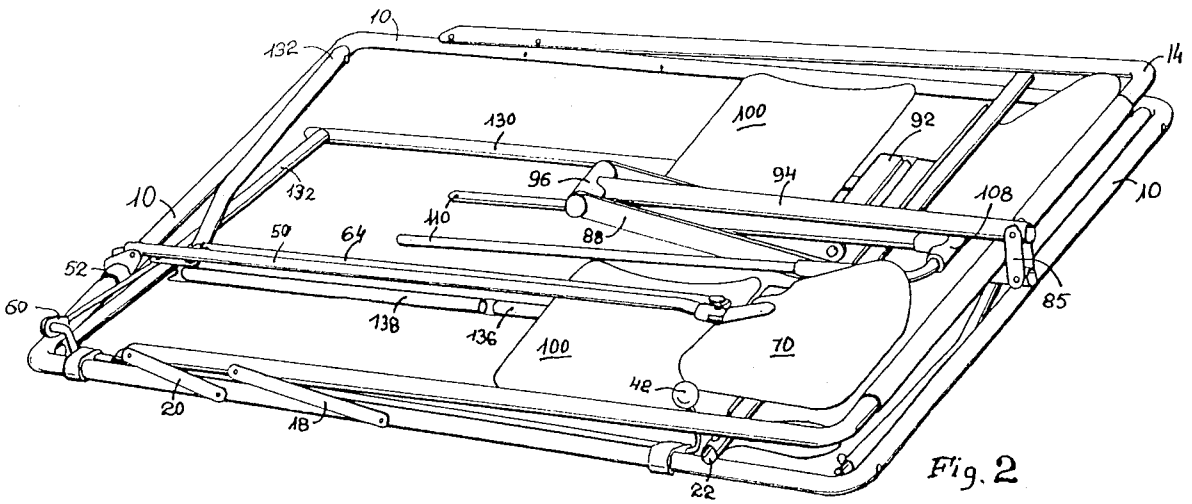
FIG. 2 illustrates the steering, propelling and driving means of the paddle boat of FIG. 1 in a fully collapsed orientation for transporting.

The paddle boat comprises a substantially rectangular main frame 10. Foldably mounted upon main frame 10 is a seat 12. Seat 12 comprises an upstanding inverted U-shaped tube 14 from which is hung a canvas or other cloth seat 16. Tube 14 is rotatably mounted onto main frame 10 by means of connecting arms 18 and 20. Connecting arms 18 and 20 are pivotably attached as by pins to both tube 14 and frame 10 so that tube 14 can be folded to lie flat atop frame 10 in a closed orientation, as illustrated in FIG. 2. The lower end of canvas seat 16 is affixed to a crossbar 22 which is affixed to frame 10.

Figure 3:
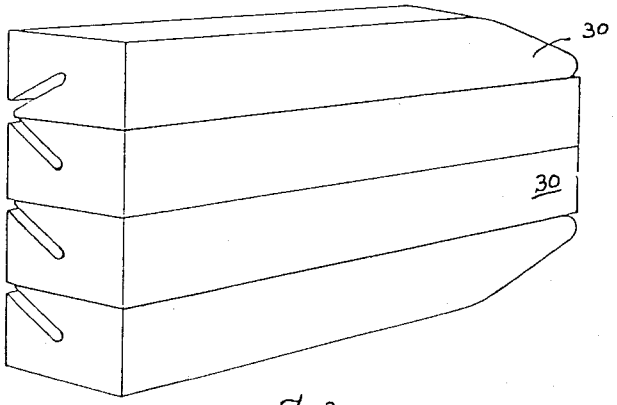
FIG. 3 illustrates the floats of the paddle boat of FIG. 1 in a folded orientation for transporting.

The paddle boat further comprises a plurality of floats 30 which serve as supports for the main frame 10 and the steering and propelling apparatus. In a preferred embodiment, four floats 30 are utilized, two floats supporting the right side of the paddle boat and two floats supporting the left side of the paddle boat. FIG. 3 illustrates four such floats 30 in a folded orientation for carrying when the paddle boat is not in use. The mounting of the main frame 10 on floats 30 during use will be described in detail hereinbelow.

With reference to FIG. 4 there is shown steering apparatus of the paddle boat of FIG. 1. The steering apparatus comprises a rod 40 mounted along the length of one side of main frame 10. Rod 40 is provided with a handle 42 adjacent seat 12. Rod 40 is mounted on frame 10 by means of mounting sleeves 44 and 46 which permit rod 40 to rotate freely about its longitudinal axis.

Rotatably affixed to the rear portion of main frame 10 is a shaft 50. Shaft 50 is affixed to a mounting member 52 and is adapted to rotate about pin 53 upon folding of the paddle boat. Pivotably mounted upon shaft 50 about pivot location 54 is pivot member 55 having first and second lever arms 56 and 58.

Rod 40 passes through sleeve 46 and then bends to enter pivot member 60 in an eccentric position. Rotatably mounted in pivot member 60 is rod 62. The farther end of rod 62 is affixed to first lever arm 56 of pivot member 55. Affixed to second lever arm 58 of pivot member 55 is a rod 64. Rod 64 extends the length of shaft 50 and then bends to enter one end of pivot member 65.

The rearward end of shaft 50 is fitted with a sleeve 66. Sleeve 66 defines an aperture through which is inserted rod 68. The top end of rod 68 is bent and affixed to the second end of pivot member 65. The lower end of rod 68 is rotatably mounted in a sleeve 69 of rudder 70.

The means of operation of the steering mechanism is as follows. Rotation of handle 42 causes rotation of rod 40 about its longitudinal axis. This in turn causes pivot member 60 to pivot, pulling rod 68 and pivot arm 56, thereby causing pivot member 55 to pivot about pivot location 54. The pivoting of pivot member 55 pulls rod 64 which is affixed to pivot member 64. Pivoting of pivot member 65 causes bent rod 68 to rotate within the aperture in sleeve 66, causing rudder 70 to change its angle, thus turning the paddle boat in the desired direction.

Figure 5A:
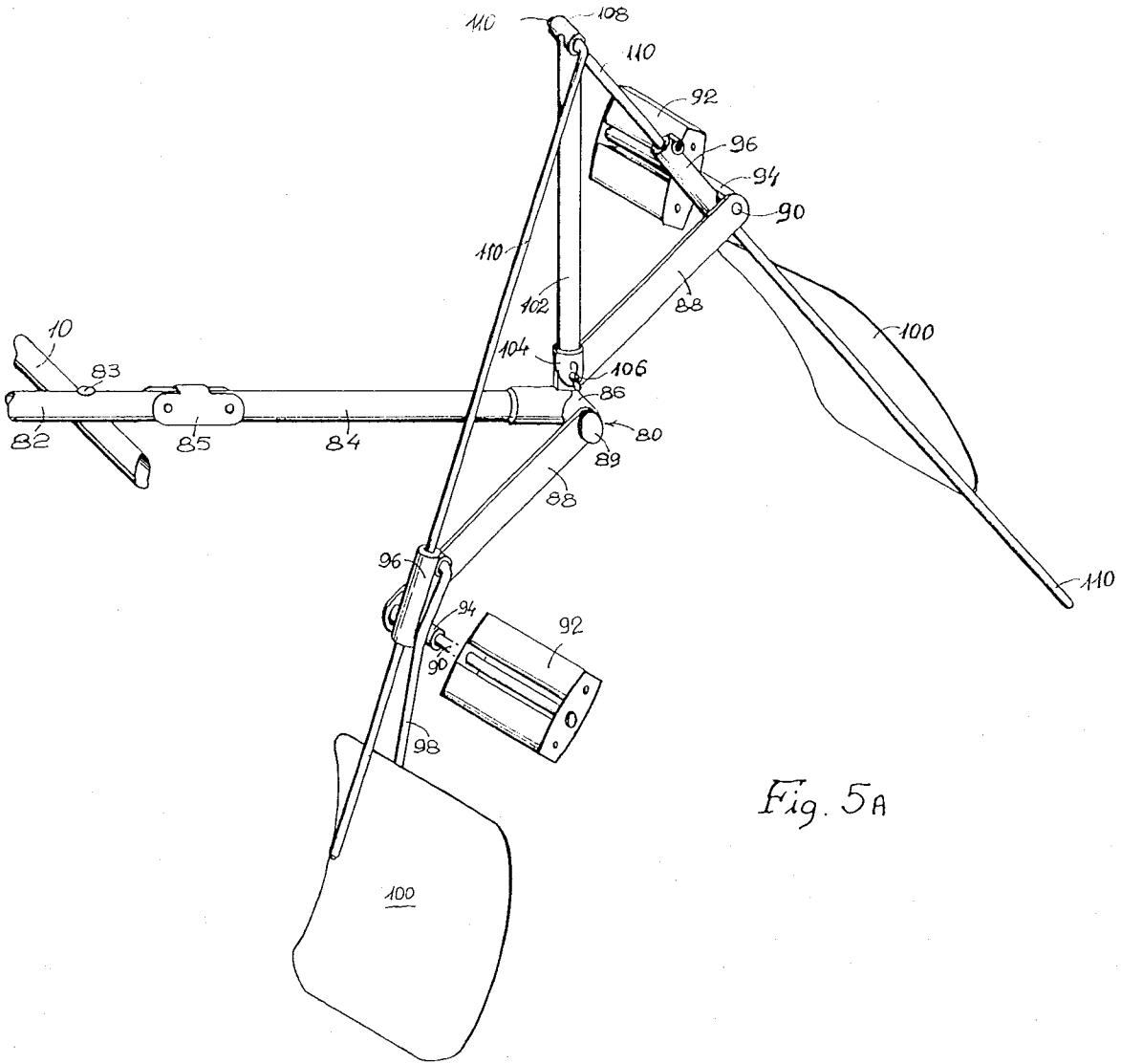
FIG. 5A is a detailed illustration of the driving and propelling mechanism of the paddle boat of FIG. 1.

With reference to FIG. 5A there is illustrated the driving and propelling mechanism of the embodiment of FIG. 1. This mechanism comprises a crank shaft 80 mounted upon main frame 10 by means of rod 82 and extension rod 84. Rod 82 is affixed to the front portion of main frame 10 as by a bolt 83 and is also secured to crossbar 22. The forwardmost end of rod 82 is connected to extension rod 84 by means of joint 85. Joint 85 permits rotation about both rod 82 and extension rod 84 so that extension rod 84 and the rest of the propelling mechanism can be folded underneath rod 82 and main frame 10 during transporting. This can be clearly seen in FIG. 2.

It will be appreciated that rod 82 may be affixed to main frame 10 at joint 85. This will provide a completely flat profile of the folded paddle boat. In this embodiment, U-shaped bar 14 of seat 12 would be slightly shorter so that when it folds, it would not be parallel to the edge of frame 10 as illustrated in FIG. 2.

Extension rod 84 is provided with a sleeve 86 which defines an axis of rotation. The central axle of crank shaft 80 rotates within sleeve 86 about this axis of rotation. Crank shaft 80 comprises two arms 88 releasably fastened at one end thereof to the central axle as by screw 80. Affixed to the outer ends of each of arms 88 is pin 90. Rotatably mounted on pins 90 are pedals 92, such as those used on bicycles. During use, arms 88 are maintained at an angle of 180° relative to one another.

Mounted about pin 90 is sleeve 94. Sleeve 94 is attached to perpendicular sleeve 96 to form one unit. Affixed to sleeve 96 is mounting rod 98 to which is attached paddle 100. Paddle 100 may be made of any conventional material and may be of conventional construction.

Mounted upon sleeve 86 is a support shaft 102. Shaft 102 is mounted in joint 104 and secured by wing nut 106. Mounted atop shaft 102 is sleeve 108. Sleeve 108 defines a second axis of rotation, parallel to and spaced from the first axis of rotation defined by sleeve 86. Rotatably mounted in sleeve 108 are two rods 110. Each rod 110 passes through one of perpendicular sleeves 96, to which paddles 100 are connected. Sleeves 96 are adapted to slide up and down along the length of rods 110 during operation of the paddle boat.

It will be appreciated that support shaft 102 has two stable orientations. During operation of the paddle boat, shaft 102 is maintained perpendicular to extension rod 84. This causes sleeve 108 to be held a certain distance above extension rod 84 and main frame 10 to permit pedalling by the operator of the paddle boat. However, when it is desired to collapse the paddle boat, wing nut 106 can be opened, permitting shaft 102 to be folded down on top of extension rod 84. At the same time, screw 89 is opened to permit arms 88 to be folded together, such that the angle between them is 0°, rather than the 180° when the paddle boat is in use.

During operation of the paddle boat, the operator, using his feet, rotates pedals 92, causing rotation of arms 88 about the central axle of crank shaft 80. Looking, for example, at FIG. 5, as the operator pushes the left pedal 92 forward and downward, left arm 88 is caused to rotate. This rotation causes sleeve 96, and attached paddle 100, to slide downwards along the length of rod 110. Paddle 100 will, thus, enter the water. Continued rotation of arm 88 causes rod 110 to swing through a restricted arc about an axis through sleeve 108. The rearward movement of rod 110 as it rotates through this restricted arc, pulls paddle 100 rearwardly through the water, causing forward propulsion of the paddle boat.

At the end of the swing of rod 110 in one direction (the position of the right pedal and paddle in FIG. 5), continued pedalling causes rod 110 to swing back in the other direction. This causes continued rotation of arm 88, now in an upward direction. Sleeve 96 rises along the length of rod 110 and paddle 100 is pulled out from the water.

It is a particular feature of the present invention that a pedalable paddle boat is provided without the need for gears, transmissions or chains. The simple, folding driving mechanism is economical and less susceptible to breakage.

It is a particular feature of the driving and propelling apparatus of the present invention that the paddles are maintained in a substantially vertical orientation at all times. This is provided by the slideable connection between the paddle and the rod hanging from the sleeve atop the support shaft, and provides greatly improved efficiency in propulsion of the paddle boat over paddle wheels or other rowing means which are not maintained in a vertical orientation.

In addition, it will be appreciated that the paddles of the paddle boat of the present invention remain at all times between the floats. This prevents damage to the paddles from other craft passing by, and prevents injury to swimmers in the vicinity of the paddle boat.

Figure 5B:
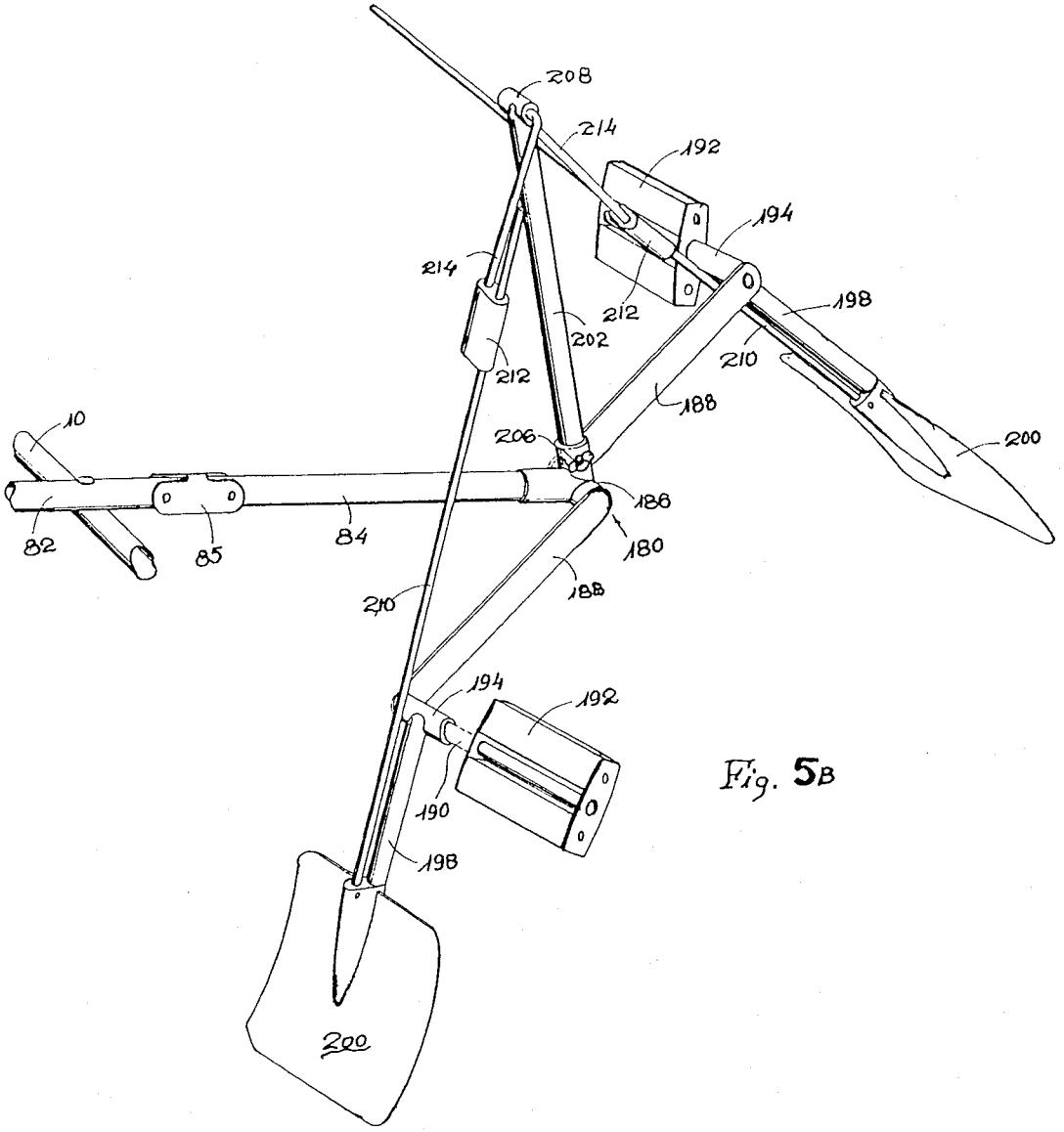
FIG. 5B is a detailed illustration of an alternate embodiment of a driving and propelling mechanism in accordance with the present invention.

With reference to FIG. 5B there is shown an alternate embodiment of the driving and propelling apparatus of the present invention. This apparatus is mounted on main frame 10 by means of rod 82 and extension rod 84 as illustrated and described with reference to FIG. 5A. It comprises a crank shaft 180 comprising a central axle mounted within a sleeve 186 and two arms 188 mounted at an angle of 180° relative to one another. For ease and economy of manufacture, crank shaft 180 may be manufactured as a single unit.

The outer end of arm 188 is provided with a pin 190. Rotatably mounted on pin 190 is a pedal 192. Also mounted on pin 190 is sleeve 194 to which is affixed mounting shaft 198. Affixed to mounting shaft 198 is paddle 200.

It will be appreciated by those skilled in the art that instead of the separate pedal 192 and paddle 200 illustrated, a single unit functioning as both may be provided. Such a unit preferably would be provided with an upper portion suitable for accomodating the foot of an operator and a lower paddle portion.

Mounted upon sleeve 186 is a support shaft 202 similar in all respects to shaft 102 described in connection with FIG. 5A. Shaft 202 is mounted in joint 104 and secured by wing nut 206. Mounted atop shaft 102 is sleeve 208. As described above, it is the role of shaft 202 during operation of the paddle boat to remain perpendicular to extension rod 84 at a height sufficient to render pedalling comfortable to the operator of the paddle boat.

Paddle 200 is affixed to a rod 210 which is slideably attached to a double sleeve 212. Fixedly attached to the second aperture of double sleeve 212 is a rod 214 which is affixed at its other end to sleeve 208 atop shaft 202. Alternatively, rod 210 may be permanently affixed to double sleeve 212 with rod 214 slideably attached thereto.

The operation of the driving and propelling apparatus of FIG. 5B is substantially similar to that illustrated and described with reference to FIG. 5A. As the operator manually rotates pedal 192, rods 210 and 214 swing through a restricted arc about an axis through sleeve 208. This rotation causes paddles 200 to be pulled backwards through the water and forwards through the air. As arm 188 rotates through 360°, rod 210, to which paddle 200 is affixed, slides upwards and then downwards along its length through double sleeve 212 causing the raising and lowering of paddle 200.

It will be appreciated that the particular feature of this invention that the paddles remain in a substantially vertical orientation throughout their movement is also a feature of the embodiment of FIG. 5B.

With reference to FIGS. 6 and 7 there is shown a float 30 as utilized in the embodiment of FIG. 1 and the apparatus for mounting main frame 10, and the seat, steering mechanism, and driving and propelling mechanism affixed thereto, onto the floats during use. Float 30 is of conventional construction. Those for use on the front of the paddle boat may be curved along their front edges for ease of movement through the water. The rear edge of the front floats and the front edges of the rear floats are straight cut for ease of alignment with one another.

Floats 30 are provided with a channel 120 therethrough. Channel 120 comprises an interiorly located cylindrical portion 122 and an exterior angled slot portion 124 for accomodation of the connection apparatus.

The connection apparatus comprises a tunnel-type member 130 which may be defined by an elongate pipe which is slit open. Tunnel member 130 is rotatably affixed to the forward and rearward corners of one side of main frame 10 by means of rods 132. Rods 132 are permanently affixed to tunnel member 130 at one end thereof and at their other end, rotatably affixed to main frame 10 as by bolts and wing nuts 134. They can, thus, be securely fastened in the open configuration when the paddle boat is in use, but by opening the wing nuts, rods 132 and tunnel member 130 can be rotated to lie within main frame 10 for packing and transporting.

Pivotably attached to the forward and rearward ends respectively of tunnel member 130 are shafts 136 and 138. During use of the paddle boat, shafts 136 and 138 serve as extensions of tunnel member 130 and fit into the interiorly located cylindrical portions 122 of channels 120 to securely retain the main frame 10 in engagement with floats 30. Shaft 136 along with forwardmost rod 132 slide into channel 120 of the front float 30, while shaft 138 and the rearmost rod 132 slide into channel 120 of rear float 30.

When it is desired to fold the paddle boat, floats 30 are removed from the shafts 136 and 138. Shafts 136 and 138 pivot about pins 140 and fit inside tunnel-type member 130. Tunnel member 130 with shafts 136 and 138 inside is then rotated to lie within main frame 10.

It will be appreciated by those skilled in the art that the invention is not limited by what has been described and shown hereinabove merely by way of example. Rather, the invention is limited solely by the claims which follow:

I claim:

1. A foldable, portable paddle boat comprising:

a main frame;

foldable driving and propelling means pivotably mounted upon said frame;

said foldable driving and propelling means comprising:

a stationary base element pivotably mounted onto said main frame and defining a first rotation axis;

a crank shaft defining at least one arm and an axle portion rotatably mounted onto said stationary base for rotation about said first rotation axis;

a stationary extension element pivotably coupled to said base element and defining a second rotation axis parallel to and spaced from said first rotation axis;

at least one rod rotatably mounted onto said extension element and arranged for rotation about said second rotation axis through a restricted arc; and a member arranged for slideable relative movement with relation to said at least one rod and fixedly mounted onto said at least one arm, whereby rotation of said arm about said first rotation axis causes said member to move slideably with relation to said rod and cause its rotation about said second rotation axis;

a paddle coupled to said member;

said paddle being adapted for movement along the length of said rod as it rotates through said restricted arc such that said paddle remains in a substantially vertical orientation throughout its movement;

steering means foldably mounted upon said frame; and a plurality of floats;

said frame being removably mountable upon said floats.

2. The paddle boat according to claim 1 and further comprising:

connection apparatus foldably attached to said main frame and adapted for revocable insertion into said floats for releasable engagement therewith for the mounting of said main frame thereupon.

3. The paddle boat according to claim 2 and wherein said floats are provided with channels for the releasable engagement of said connection apparatus.

4. The paddle boat according to claim 1 and wherein said steering means comprises:

a handle;

rudder means foldably mounted upon said frame; and connecting means for converting movement of said handle to movement of said rudder means.

5. The paddle boat of claim 4 and wherein said rudder means comprises a rudder rotatably mounted on a shaft foldably mounted upon said frame, and wherein said connecting means comprises:

a plurality of rods interconnected by means of a plurality of pivot members which act to translate rotational movement of said handle into a change of angle of said rudder.

6. A paddle boat according to claim 1 and further comprising a driving pedal coupled to said at least one arm in fixed relation to said paddle.

7. A foldable, portable paddle boat comprising:

a main frame;

a stationary base element pivotably mounted onto said main frame and defining a first rotation axis;

a crank shaft defining at least one arm and an axle portion rotatably mounted onto said stationary base for rotation about said first rotation axis;

a stationary extension element pivotably mounted onto said base element and defining a second rotation axis parallel to and spaced from said first rotation axis;

said extension element adapted to selectably pivot about said base element into a collapsed orientation;

at least one rod rotatably mounted onto said extension element and arranged for rotation about said second rotation axis through a restricted arc;

a member arranged for slideable relative movement with relation to said at least one rod and fixedly mounted onto said at least one arm, whereby rotation of said arm about said first rotation axis causes said member to move slideably with relation to said rod and cause its rotation about said second rotation axis;

a paddle coupled to said member;

said paddle being adapted for movement along the length of said rod as it rotates through said restricted arc such that said paddle remains in a substantially vertical orientation throughout its movement;

a steering handle;

rudder means foldably mounted upon said frame;

connecting means for converting movement of said handle to movement of said rudder means;

a plurality of floats; and connection apparatus foldably attached to said main frame and adapted for removable insertion into said floats for the mounting of said main frame upon said floats.

8. Collapsible apparatus for propelling a water craft comprising:

a stationary base element pivotably mounted onto said craft and defining a first rotation axis;

a crank shaft defining at least one arm and an axle portion rotatably mounted onto said stationary base for rotation about said first rotation axis;

a stationary extension element pivotably mounted onto said base element and defining a second rotation axis parallel to and spaced from said first rotation axis;

at least one rod rotatably mounted onto said extension element and arranged for rotation about said second rotation axis through a restricted arc;

a member arranged for slideable relative movement with relation to said at least one rod and fixedly mounted onto said at least one arm, whereby rotation of said arm about said first rotation axis causes said member to move slideably with relation to said rod and cause its rotation about said second rotation axis; and a paddle coupled to said member and being adapted for movement along the length of said rod as it rotates through said restricted arc such that said paddle remains in a substantially vertical orientation throughout its movement.

9. A paddle boat according to claim 8 and further comprising a driving pedal coupled to said at least one arm in fixed relation to said paddle.

* * * * *